US008245673B2

(12) United States Patent
Howell-Smith

(10) Patent No.: US 8,245,673 B2
(45) Date of Patent: Aug. 21, 2012

(54) OPPOSED PISTON COMBUSTION ENGINE

(75) Inventor: Bradley Howell-Smith, Queensland (AU)

(73) Assignee: Revetec Holdings Limited, Southport, Queensland (AU)

( * ) Notice: Subject to any disclaimer, the term of this patent is extended or adjusted under 35 U.S.C. 154(b) by 392 days.

(21) Appl. No.: 12/440,338

(22) PCT Filed: Sep. 7, 2007

(86) PCT No.: PCT/AU2007/001331

§ 371 (c)(1),
(2), (4) Date: May 12, 2009

(87) PCT Pub. No.: WO2008/028252

PCT Pub. Date: Mar. 13, 2008

(65) Prior Publication Data

US 2009/0314232 A1 Dec. 24, 2009

(30) Foreign Application Priority Data

Sep. 7, 2006 (AU) ..... 2006904920

(51) Int. Cl.
*F02B 75/22* (2006.01)
*F02B 75/32* (2006.01)

(52) U.S. Cl. ..... 123/55.3; 123/55.2; 123/55.4; 123/53.3; 123/53.4; 123/197.1

(58) Field of Classification Search ..... 123/53.3, 123/53.4, 55.2, 55.3, 55.4, 197.1
See application file for complete search history.

(56) References Cited

U.S. PATENT DOCUMENTS

| | | | | | |
|---|---|---|---|---|---|
| 793,270 | A * | 6/1905 | Blomgren | 123/54.3 |
| 1,830,046 | A * | 11/1931 | White | 123/54.3 |
| 3,584,610 | A * | 6/1971 | Porter | 123/54.3 |
| 3,948,230 | A * | 4/1976 | Burns | 123/54.3 |
| 4,848,282 | A | 7/1989 | Chaneac | |
| 5,606,938 | A * | 3/1997 | Rowe | 123/54.3 |
| 5,634,441 | A * | 6/1997 | Ragain | 123/54.3 |
| 5,992,356 | A * | 11/1999 | Howell-Smith | 123/55.3 |
| 6,692,394 | B2 * | 2/2004 | Takenaka | 475/5 |
| 6,769,384 | B2 * | 8/2004 | Dougherty | 123/54.1 |

FOREIGN PATENT DOCUMENTS

| | | |
|---|---|---|
| FR | 2307132 | 11/1976 |
| WO | WO 97/04225 | 2/1997 |

* cited by examiner

*Primary Examiner* — Noah Kamen
*Assistant Examiner* — Grant Moubry
(74) *Attorney, Agent, or Firm* — David W. Carstens; Jeffrey G. Degenfelder; Carstens & Cahoon, LLP

(57) ABSTRACT

An engine comprising: a shaft (6) having a first multilobate cam (5*a*) axially fixed to said shaft (6) and an adjacent second multilobate cam (5*b*) differentially geared to said first multilobate and a pair of diametrically opposed pistons (1*a*, 1*b*) which pistons of a pair of pistons are rigidly interconnected by a connecting plate (4) and wherein, reciprocating motion of said pistons imparts rotary motion to said shaft via contact between said pistons and the camming surfaces of said multilobate cams.

22 Claims, 3 Drawing Sheets

OPPOSED PISTON COMBUSTION ENGINE

CROSS-REFERENCE TO RELATED APPLICATIONS

This application is a US National Stage submission under 35 USC 371 of PCT Application Number PCT/AU2007/001331 filed Sep. 7, 2007, which claims the benefit of and priority to Australian application number AU 2006904920 filed Sep. 7, 2006.

TECHNICAL FIELD

This invention relates to internal combustion engines. In particular, the invention relates to improvements in layout and compactness of the engine described in International Application No. PCT/AU96/00449 (International Publication No. WO 97/04225) entitled "Opposed Piston Combustion Engine" in the name of a subsidiary company of the present applicant, that subsidiary being Revolution Engine Technologies Pty Ltd. The entire content of WO 97/04225 is incorporated herein by cross-reference.

BACKGROUND ART

Internal combustion engines such as used in automobiles are typically of the reciprocating type in which a piston oscillating in a cylinder drives a crankshaft via a connecting rod. There are numerous disadvantages in the conventional reciprocating engine design, which disadvantages in large stem from the lack of mechanical advantage that the connecting rod has to transfer power to the crankshaft over a complete stroke.

A connecting rod achieves its maximum mechanical transfer at approximately 60 degrees After Top Dead Centre (ATDC). The engine described in WO 97/04225 addresses this lack of mechanical transfer by spreading the maximum mechanical transfer over a greater range of degrees of rotation. This has resulted in high torque over a large RPM range providing a very flat torque curve.

During a project aimed at developing the engine described in WO 97/04225 for aircraft use, it was found that on a counter rotating three lobed drive cam design (trilobate) that the cam lobes become in phase every 60 degrees of rotation. This feature offers the potential for the incorporation of two sets of piston assemblies per one counter rotating dual trilobate assembly in each module of the engine.

It is an object of the present invention to improve on the engine the subject of WO 97/04225 by exploiting the feature referred to in the previous paragraph.

SUMMARY OF THE INVENTION

In a broad format, the invention provides an internal combustion engine comprising at least one cylinder module, said cylinder module comprising:

a shaft having a first multilobate cam axially fixed to said shaft and an adjacent second multilobate cam differentially geared to said first multilobate cam for axial counter rotation about said shaft;

two pairs of cylinders associated with said multilobate cams, the cylinders of each pair being diametrically opposed with respect to said shaft with said multilobate cams interposed therebetween; and a piston in each said cylinder, which pistons of a pair of cylinders are rigidly interconnected;

wherein: said multilobate cams each comprise 3+n lobes where n is zero or an even-numbered integer; and, the axes of the pairs of cylinders are at an angle to each other of half of the number obtained by dividing 360° by the number of lobes on a cam;

and wherein, reciprocating motion of said pistons in said cylinders imparts rotary motion to said shaft via contact between said pistons and the camming surfaces of said multilobate cams.

As noted above, it has been found that typically in an engine comprising a drive system of counter-rotating trilobate cams that the cams—or more specifically the lobes thereof—become in phase at every 60 degrees of rotation. This provides a means to configure cylinder bores at a 60 degree X configuration as shown in FIG. 1 of the accompanying drawings. As described in WO 97/04225, the drive cams of the engine can have 3, 5, 7 or any odd number of cam lobes above 3. Typically, a 5 lobed cam will provide a 36 degree X configuration while a 7 lobed cam will provide a 25.713 degree X configuration, and so on when the number of cam lobes is increased.

In WO 97/04225 it is disclosed that the pairs of cylinders are typically disposed at 90 degrees to each other. In the improved engine the subject of this invention, the cylinders of a pair are disposed at 180 degrees to each other as in the WO 97/04225 engine, but the two pairs of cylinders are disposed in an X configuration and at either 60, 36, 25.713 degrees and so on, to each other.

Like the engine described in WO 97/04225, the improved engine can comprise a plurality of modules in which each module consists of two pairs of cylinders. The modules can be phased inline at 0 degrees to each other or can be out of phase by any angle. In a two module engine comprising two dual trilobate cam assemblies, the two modules are typically configured at 30 degrees to each other.

By incorporating an X configuration the pistons are typically joined using two offset connecting plates mounted between the trilobate cams (see FIGS. 2 and 4). It will be noted that one plate mounted between the trilobate cams and one piston link can be used to bridge the trilobate cams.

In the engine described in WO 97/04225, a differential gearing is used to provide the counter rotation of the trilobate cams and that any manner of differential gearing may be incorporated in any manner known in the art. In the improved engine of the present invention, a separate output shaft is used.

The output shaft referred to in the previous paragraph provides the reverse gearing required and is at a ratio of 1:3 of the trilobate cams. This provides an output shaft speed that is consistent with conventional reciprocating internal combustion engines and allows balance shafts to be used. With an engine comprising 5 lobe drive cams, it is desirable to use a 1:5 ratio for the output shaft. However, any ratio can be used.

An advantage of incorporating an output shaft is that power can be taken off either the main cam drive shaft or the output shaft thereby providing two speed/torque ranges.

By configuring the cylinder pairs in a module in a 60 degree X configuration, two thirds of the reciprocating mass of the piston assemblies is counteracted by the opposing piston assembly. This will be explained below with reference to FIG. 2. This reduces the amount of balance weight required to balance the piston assembly to one third of the amount of balance weight required in the engine described in WO 97/04225. Balance shafts are shown in FIG. 3 and balance weights are shown in FIG. 5. It will be noted that an increase of lobes on the drive cams will reduce the amount of balance mass required.

In the WO 97/04225 engine, the pistons are interconnected via rods and guide sleeves. However, as noted above, a piston pair of the improved engine can be joined using a connecting plate. When a connecting plate is employed, guide bushes or slides are used to control piston twist and control piston movement.

The piston guide bushes or slides referred to in the previous paragraph are preferably mounted onto the connecting plate. However, the guides can alternatively be mounted to the piston, the piston guide plate (see below), the piston bearing shaft, or any position in the assembly that can control piston twist and movement. Typically two guides are used but four guides can be employed, fitted radially with respect to the piston to allow for expansion and contraction. However, the guide bushes may be fitted non-radially.

The drive cams of the engine the subject of WO 97/04225 engine are described as being asymmetrical. An advantage of this feature is that any connecting rod ratio can be simulated via the drive cam design. A typical connecting rod ratio in a conventional reciprocating internal combustion engine is be 1.6:1. The equivalent of the connecting rod ratio in the engines the subject of the present and WO 97/04225 can be any ratio providing increased breathing and performance over a conventional reciprocating internal combustion engine. An endless/infinite connecting rod ratio or a near constant velocity piston speed can be simulated providing better performance in external combustion engines like that over a steam driven piston.

Having broadly described the invention, an improved engine will now be exemplified with reference to the accompanying drawings briefly described hereafter.

BEST MODE OF CARRYING OUT THE INVENTION

Figure 1:
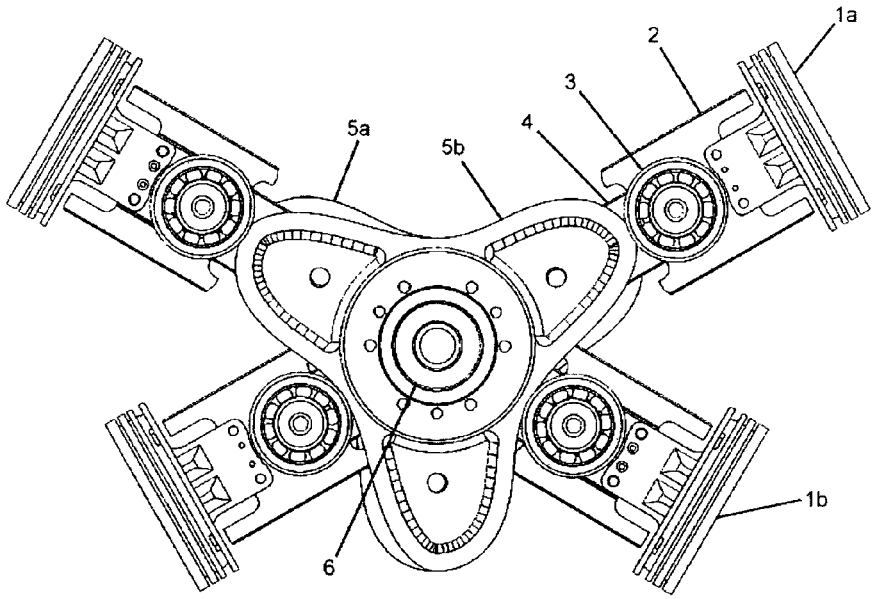
FIG. 1 is a front view of internal components of the improved engine.

With reference to FIG. 1, there is shown a four cylinder four stroke engine comprising two pairs of opposed cylinders. As with the other drawings, the outer engine casing has been omitted so that internal components can be seen. Piston assemblies 1*a* and 1*b* are shown at 60 degrees spread axial of the output shaft 6. The piston assembly consists of a connecting plate 4 which is fixed to the piston guide 2 via a pin through piston bearing 3, dowel pins and bolts as part of the piston fixing. Also shown is the two counter-rotating trilobate drive cams 5*a* and 5*b*.

While piston assembly 1*a* is at Top Dead Centre (TDC) and on the firing cycle, the piston assembly 1*b* top piston is at TDC finishing the exhaust stroke and entering the induction stroke. As the drive cams counter-rotate the piston assembly 1*a* and bearings 3 spread the drive cams apart with a scissor like action. In turn the piston assembly lb moves downward on the induction stroke. Both pistons move downward at the same rate and being 60 axial to the output shaft, two thirds of the reciprocating mass is counter acted by the opposing piston assembly.

Figure 2:
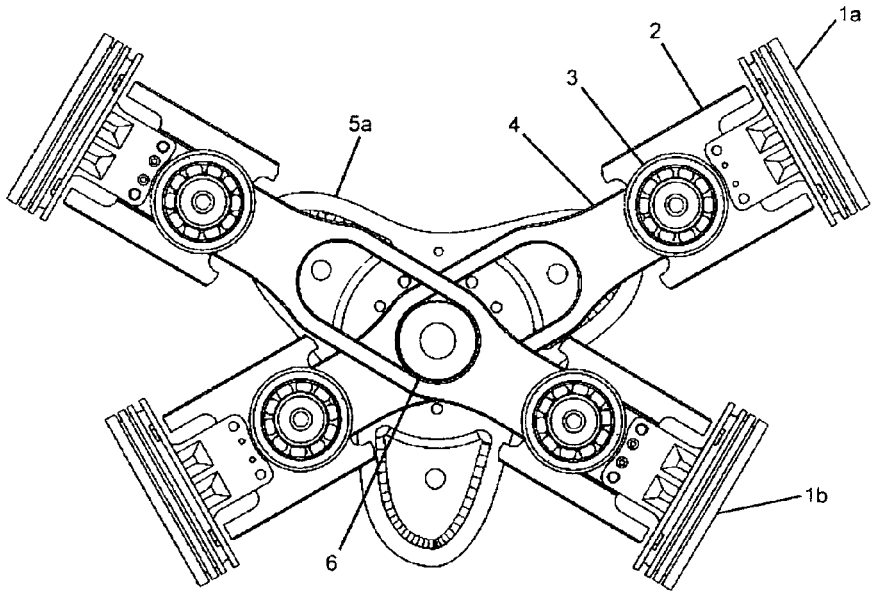
FIG. 2 is the same view of the assembly depicted in FIG. 1 with the front trilobate drive cam removed.

In FIG. 2, an offset piston connecting plate 4 can be seen in greater detail. Note the oval cutout in the plate to allow the piston assembly to reciprocate.

Figure 3:
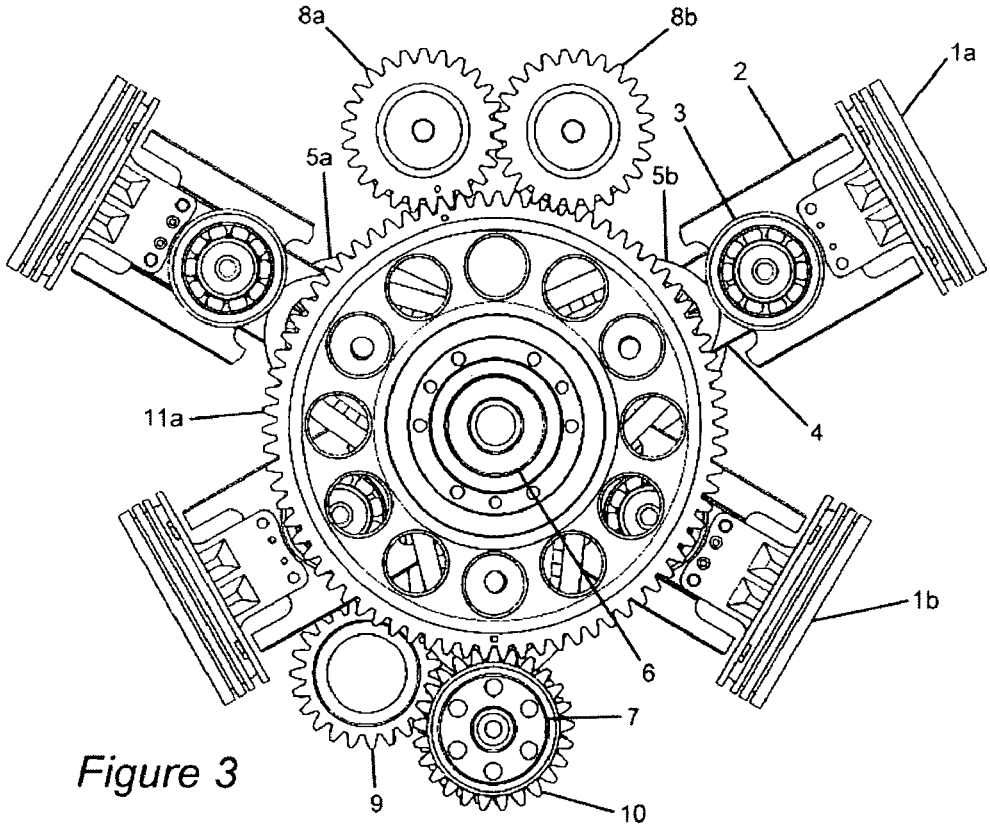
FIG. 3 is the same view of the assembly depicted in FIG. 1 with the gearing and shafts shown.

Gears 10 and 11*a* are shown in FIG. 3. These gears give a 1:3 ratio providing two piston strokes per revolution as is featured in conventional internal combustion engines. Also shown in FIG. 3 are the drive gears for the balance shafts 8*a* and 8*b*, and drive idler gear 9 which provides opposite direction drive.

With further reference to FIG. 3, as the drive cam 5*b* moves in the counter-clockwise direction it turns the main shaft 6 and in turn drives gear 11*a*. Gear 11*a* then turns the front gear 10 and output shaft 7 in the clockwise direction. While the piston assemblies 1*a* and 1*b* cancel out two thirds of the reciprocating mass the balance shafts 8*a* and 8*b* are turned also by main shaft gear 11*a* balancing out the final third of reciprocating mass.

Figure 4:
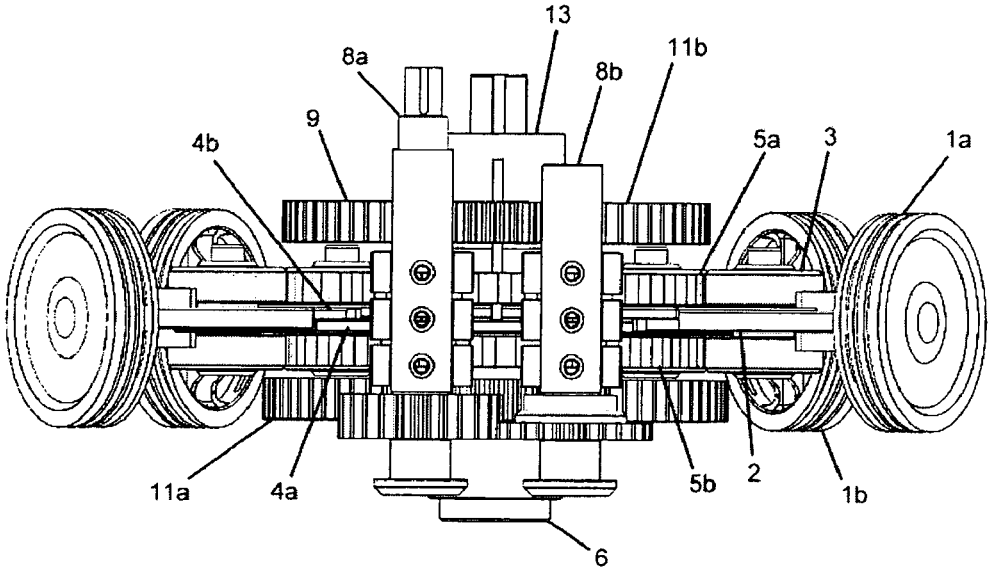
FIG. 4 is a top view of the assembly depicted in FIG. 3.

With reference to FIG. 4, shown are the offset piston plates 4*a* and 4*b* between the drive cams 5*a* and 5*b*. Also shown is the reversing hub 13 to which the rear drive cam 5*a* is mounted and the rear reversing hub gear 11*b*. Rear drive cam 5*a* is driven by the piston assembly in a clockwise direction. This drive cam is mounted on to reversing hub/sleeve 13 over the main shaft 6. Rear drive cam 5*a* turns sleeve 13 and in turn drives the rear drive gear 11*b*.

Figure 5:
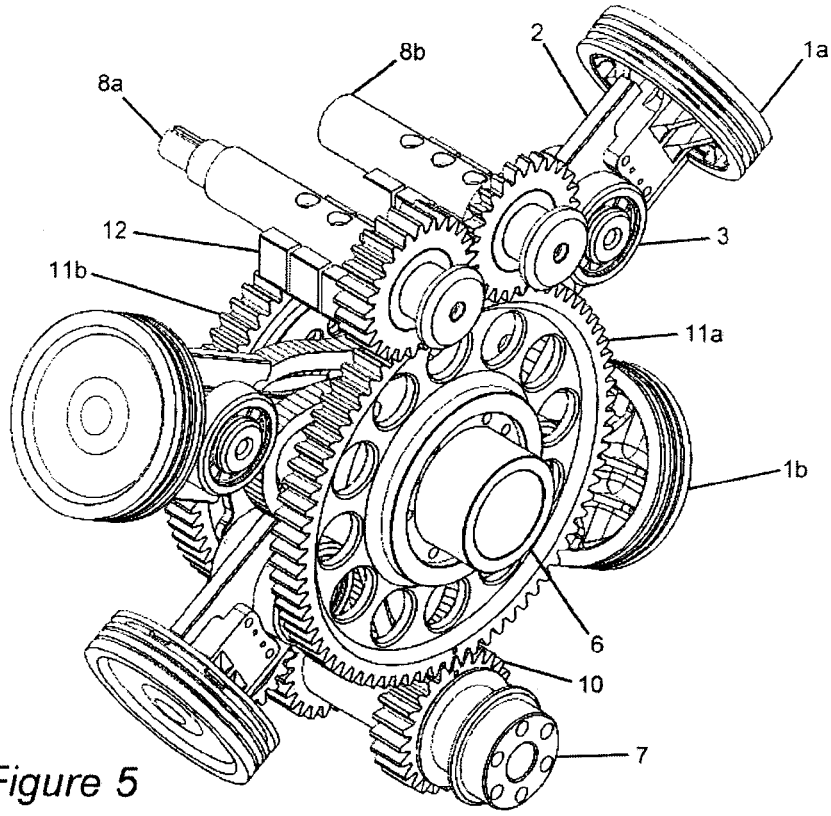
FIG. 5 is a front isometric view showing the positional relationships of the engine's components in greater detail.

With reference to FIG. 5, piston guide plate 2 is held by oil fed guide bushes fitted into the engine block controlling piston twist caused by the bearings 3 driving the drive cams 5*a* and 5*b*.

Figure 6:
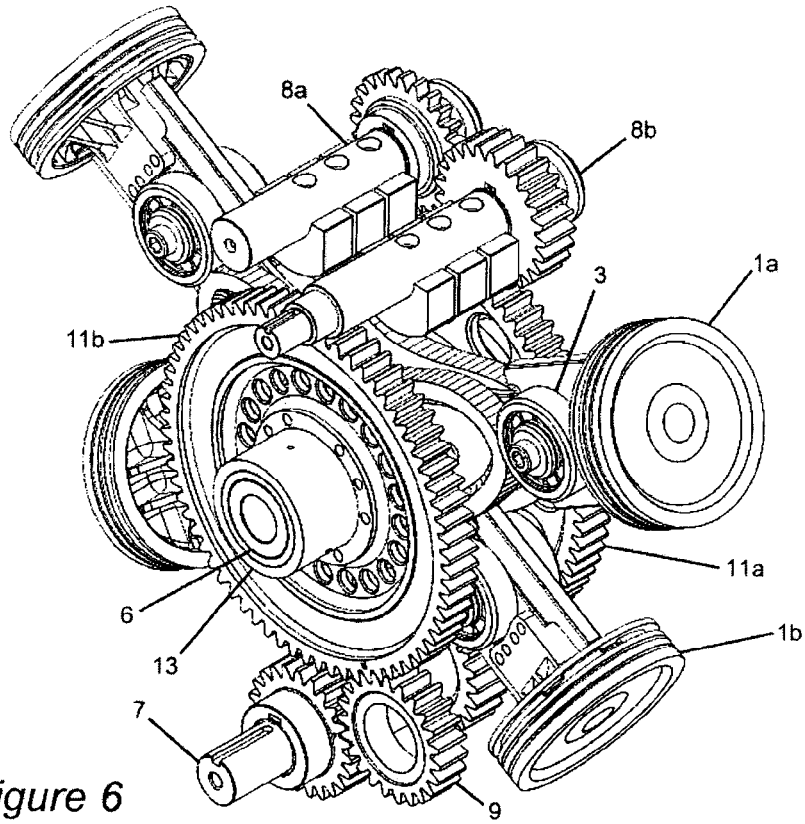
FIG. 6 is a rear isometric view showing balance weights on balance shafts.

In FIG. 6, balance weights 12 on the balance shafts 8*a* and 8*b* can be seen. Also shown are the output shaft and gear 7 meshing with the drive idler gear 9 and reversing hub 11*b* which is part of the reverse gearing. The rear drive gear turns the idler drive gear 9 in a counter-clockwise direction, the idler gear 9 then drives the output shaft 7 in a clockwise direction providing the required reverse gearing.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

Any reference to publications cited in this specification is not an admission that the disclosures constitute common general knowledge in Australia.

The invention claimed is:

1. An internal combustion engine comprising at least one cylinder module, said cylinder module comprising:

a shaft having a first multilobate cam axially fixed to said shaft and an adjacent second multilobate cam differentially geared to said first multilobate cam for axial counter rotation about said shaft;

two pairs of cylinders associated with said multilobate cams, each pair of cylinders driving a respective one of the multilobate cams, each pair of cylinders having an axis, the cylinder of each pair being diametrically opposed with respect to said shaft with said multilobate cams interposed therebetween; and a piston in each said cylinder, which pistons of a pair of cylinders are rigidly interconnected;

wherein: said multilobate cams each comprise 3+n lobes where n is zero or an even-numbered integer; and, the axes of the pairs of cylinders are at an angle to each other of half of the number obtained by dividing 360° by the number of lobes on a cam;

and wherein, reciprocating motion of said pistons in said cylinders imparts rotary motion to said shaft via contact between said pistons and the camming surfaces of said multilobate cams.

2. The engine of claim 1, wherein each lobe of the multilobate cams is asymmetric.

3. The engine of claim 1, wherein the pistons of each pair of pistons are interconnected by a connecting plate.

4. The engine of claim 1, wherein the engine is a four-stroke engine.

5. The engine of claim 1, comprising from 2 to 6 cylinder modules.

6. The engine of claim 5, wherein the modules are phased inline at 0 degrees to each other or out of phase by any angle.

7. The engine of claim 1, wherein contact between said pistons and the camming surfaces of said multilobate cams is via roller bearings.

8. The engine of claim 7, wherein said roller bearings have a common axis.

9. The engine of claim 7, wherein axes of said roller bearings are offset with respect to each other and said piston axis.

10. The engine of claim 1, wherein said cams are trilobate.

11. The engine of claim 7, wherein the axes of the pair of cylinders are at a 60 degree angle to each other forming an X configuration.

12. The engine of claim 7, wherein the pistons are connected by two offset connecting plates mounted between trilobate cams.

13. The engine of claim 1 comprising a further output shaft.

14. The engine of claim 13, wherein said output shaft provides counter rotation of the multilobate cams.

15. The engine of claim 13, wherein said shaft provides reverse gearing at a ratio of 1:3 when said cams are trilobate.

16. The engine of claim 13, wherein said shaft provides reverse gearing at a ratio of 1:5 when said cams comprise 5 lobes.

17. The engine of claim 13, wherein power is taken off both shafts providing two speed/torque ranges.

18. The engine of claim 1, wherein said engine further comprises balance shafts and/or balance weights that counteract the reciprocating mass of the pistons.

19. The engine of claim 18, wherein the balancing shafts are counter rotating balancing shafts.

20. The engine of claim 1, wherein a further output shaft is at least partially driven by the second multilobate cam via a second drive gear.

21. The engine of claim 1, the cylinder module further including a reverse gearing assembly comprising a first gear driven by the first multilobate cam in a first direction;

a second gear driven by the second multilobate cam in a second direction opposite to the first direction;

a third gear driven by the first gear in the second direction; and a further output shaft being driven by the second gear and the third gear.

22. The engine of claim 21, wherein the first gear driven is driven by the first multilobate cam via the shaft, and the second gear is driven by the second multilobate cam via a reversing sleeve concentric to the shaft.

* * * * *